US006164630A

United States Patent [19]

Birdsell et al.

[11] Patent Number: 6,164,630

[45] Date of Patent: Dec. 26, 2000

[54] PORTABLE HUMIDIFIER WITH WATER TREATMENT SUBSTANCE DISPENSER

[75] Inventors: Walter Birdsell, Marlborough; John Longan, Shrewsbury, both of Mass.

[73] Assignee: Honeywell Inc., Minneapolis, Minn.

[21] Appl. No.: 09/216,271

[22] Filed: Dec. 18, 1998

[51] Int. Cl.[7] ..... B01F 3/04

[52] U.S. Cl. ..... 261/18.1; 261/72.1; 261/DIG. 46; 222/185.1; 222/190; 222/209

[58] Field of Search ..... 261/1, 18.1, 72.1, 261/DIG. 46; 210/764; 222/185.1, 190, 209

[56] References Cited

U.S. PATENT DOCUMENTS

| | | | |
|---|---|---|---|
| 3,156,383 | 11/1964 | Melli | 222/209 |
| 3,266,532 | 8/1966 | Stewart | 222/209 |
| 4,596,343 | 6/1986 | Ford, Jr. | 222/209 |
| 4,701,286 | 10/1987 | Stillman et al. | 261/72.1 |
| 4,846,376 | 7/1989 | Palmer | 222/190 |
| 5,547,615 | 8/1996 | Jane et al. | 261/72.1 |
| 5,664,704 | 9/1997 | Meadows et al. | 222/209 |
| 5,823,399 | 10/1998 | Gartner | 222/209 |
| 6,019,355 | 2/2000 | Birdsell et al. | 261/72.1 |

*Primary Examiner*—C. Scott Bushey
*Attorney, Agent, or Firm*—John E. Toupal; Harold G. Jarcho

[57] ABSTRACT

A humidifier including a base defining a reservoir for liquid; a humidification mechanism for inducing dispersion of moisture withdrawn from the reservoir; a liquid storage tank having an outlet communicating with the reservoir and adapted to feed liquid thereto; and a container retaining a volume of a liquid treatment substance and defining a discharge opening communicating with the storage tank. Also included is an actuator mechanism operable to induce the discharge of a given dose portion of the treatment substance through the discharge opening into the storage tank.

17 Claims, 6 Drawing Sheets

PORTABLE HUMIDIFIER WITH WATER TREATMENT SUBSTANCE DISPENSER

BACKGROUND OF THE INVENTION

The invention relates generally to a portable electric humidifier and, more particularly, to a portable electric humidifier having an automatic bacteriastat dispenser.

Many types of humidifiers are used to increase environmental humidity. Such humidifiers use a variety of different output mechanisms to disperse, from a supply reservoir, water which has been preconditioned by, for example, atomization, evaporation or vaporization. Generally the supply reservoir is replenished by a supply tank periodically filled with a convenient source of tap water.

Humidifier operating problems are caused by biological organisms existing in the tap water or acquired from the surrounding air. The warm, moist, oxygen rich environment associated with a humidifier provides an excellent habitat for biological growth which can include algeas, slimes, and bacteria. In addition to being unsightly, such growths can foul humidifier operating surfaces resulting in reduced operating efficiency.

Problems associated with biological growth can be significantly reduced by the addition of suitable biocide chemicals such as a bacteriastat to the water employed in the humidifier. Typically, water treatment substances are added to tap water used to fill a storage tank which provides a controlled flow of water to the humidifier's operating reservoir. However, the addition of water treatment materials during each tank refilling operation is tedious and time consuming. Consequently, water treatment procedures often are ignored resulting in biological growth that decreases operating efficiency.

Disclosed in the prior art are systems for Controlling biological growth in portable humidifiers. For example, U.S. Pat. No. 4,663,091 discloses an electrode system for water sterilization; U.S. Pat. No. 5,110,511 discloses a system for timed release of a biocide; and U.S. Pat. No. 5,248,454 discloses a water supply tube coated with an algicide. Also, U.S. Pat. No. 4,701,286 discloses an evaporative cooler having a dispenser. Also disclosed in U.S. Pat. No. 5,547,615 is a portable humidifier having a dispenser assembly which automatically dispenses a given dose portion of a water treatment substance in response to filling of a storage tank. However, none of the prior control systems has been economically and operationally suitable for use with conventional portable humidifiers.

The object of this invention, therefore, is to provide an improved portable humidifier that alleviates operating problems associated with biological growth.

SUMMARY OF THE INVENTION

The invention is a humidifier including a base defining a reservoir for liquid; a humidification mechanism for inducing dispersion of moisture withdrawn from the reservoir; a liquid storage tank having an outlet communicating with the reservoir and adapted to feed liquid thereto; and a container retaining a volume of a liquid treatment substance and defining a discharge opening communicating with the storage tank. Also included is an actuator mechanism operable to induce the discharge of a given dose portion of the treatment substance through the discharge opening into the storage tank. The actuator insures the discharge of the given dose portion of treatment substance into the liquid retained by the storage tank.

According to certain features of the invention, the tank is removably mounted on the base and defines a fill opening for accommodating a filling operation of the tank with liquid, and the actuator functions to discharge a dose portion of the treatment substance in response to each filling operation. These features insure that all moisture dispersed by the humidifier will contain a proper quantity of treatment substance.

According to another feature of the invention, the actuator mechanism includes a cap removably securable to the tank over the fill opening, and wherein securement of the cap to the tank induces the discharge of the given dose portion of the treatment substance. Replacement of the cap after each filling of the tank automatically induces a discharge of treatment substance.

According to yet another feature of the invention, the actuator mechanism further includes a coupling mechanism retaining the container within the tank and arranged to respond to the securement of the cap by increasing liquid pressure in the container to thereby induce discharge of a given dose portion of the treatment substance. Provision of a pressure increase in the container insures the dispensing of a dose portion of treatment substance.

According to a further feature of the invention, the cap is removably securable to the tank by engageable threads thereon, and relative movement between the tank and the cap during engagement of the threads induces discharge of the given dose portion. These features insure a treatment substance discharge in direct response to each replacement of the storage tank cap.

According to a further feature of the invention, the container includes one end portion defining the discharge opening and an opposite end portion contractible to reduce the volume of the container and thereby produce the increase in liquid pressure therein. The contractible container end portion efficiently provides the desired pressure increase.

According to still another feature of the invention, the opposite end portion is formed by a resilient bellows wall section contractible in response to the application of force and expandable in response to removal of the force. The bellows wall section is an effective mechanism for first providing a pressure increase during contraction and then reducing the pressure in response to expansion.

According to yet further features of the invention, the coupling mechanism is adapted during relative movement between the tank and the cap to restrict relative movement between the tank and the container while allowing contraction of the bellows wall section. This feature insures desired contraction of the bellows wall section in response to replacement of the cap.

According to still other features of the invention, the coupling mechanism includes a cylindrical collar securing to the tank a retainer portion disposed between said one end portion and said bellows wall section and an engagement member moveable with the cap and engageable with the bellows wall section, the retainer portion formed by transversely projecting flange portions engaged by inwardly directed shoulder portions defined by one end of the cylindrical collar. These features provide with a simple structural relationship desired functions for the actuator mechanism.

According to another feature of the invention, the cylindrical collar has an opposite end defining an outwardly directed flange with an upper surface engaged by a contact surface of the tank so as to prevent relative movement between the cylindrical collar and the tank during relative movement between the cap and the tank. This feature provides with simple structure the desired retention of the container during replacement of the cap.

The invention also encompasses a container filled with a liquid treatment substance for humidifiers and including one end portion defining a discharge opening; an opposite end portion defining a bellows wall section contractible to reduce the volume of the container; and a mid-portion disposed between the bellows wall section and the one end portion, the mid-portion defining transversely projecting flange retainer portions. The container is particularly well suited for use with the humidifier of the invention.

According to one feature of the container, the discharge opening is an orifice having a diameter between 0.2 and 0.3 millimeters. The small orifice prevents flow of treatment substance in the absence of increased pressure within the container.

According to another feature, the container is a molded unit including a tab closing the orifice and detachable to open the orifice. The detachable molded tab simplifies manufacture and use of the container.

According to yet other features of the container, the mid-portion includes a tubular portion with an elliptical cross-section and a substantially circular collar portion joining the tubular portion and the bellows wall section, and wall portions of the tubular portion are recessed from the circular collar portion. The recessed wall portions form the transversely projecting flange retainer portions.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
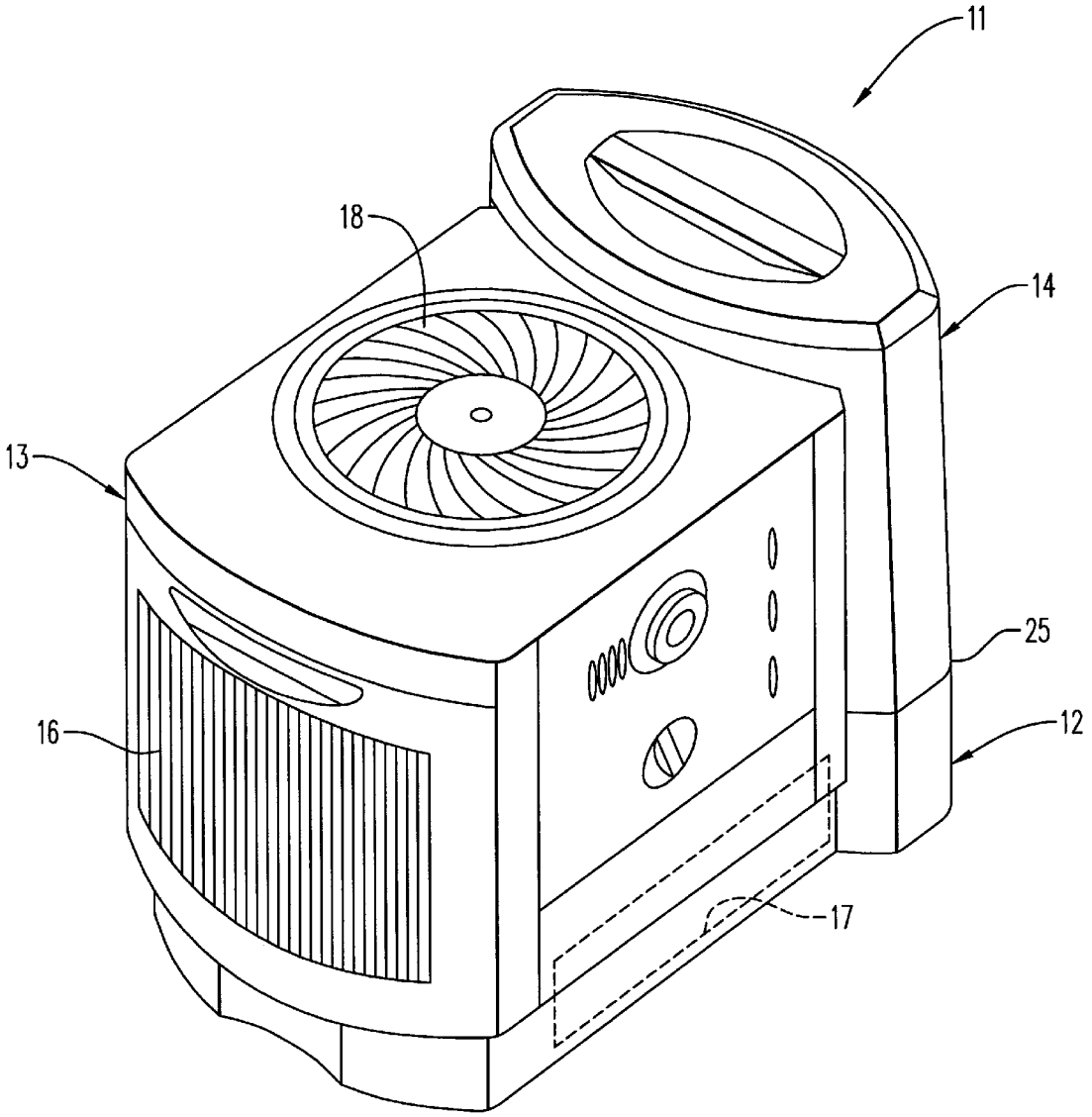
FIG. 1 is a front perspective view of a humidifier according to the invention.

A humidifier 11 (FIG. 1) includes a base 12, a humidification unit 13 and a liquid storage tank 14 mounted in juxtaposed positions on the base 12, and a water treatment substance dispensing assembly 15 (FIG. 3) removably mounted within the storage tank 14. The humidification unit 13 has an air inlet 16 and an outlet 18 for dispersing moisture into a surrounding environment. Defined by the base 12 is an internal reservoir 17 that receives water gradually discharged by the storage tank 14. The humidification unit 13 and associated reservoir 17 can be of any conventional type including for example, those shown in noted U.S. Pat. No. 5,547,615.

Figure 2:
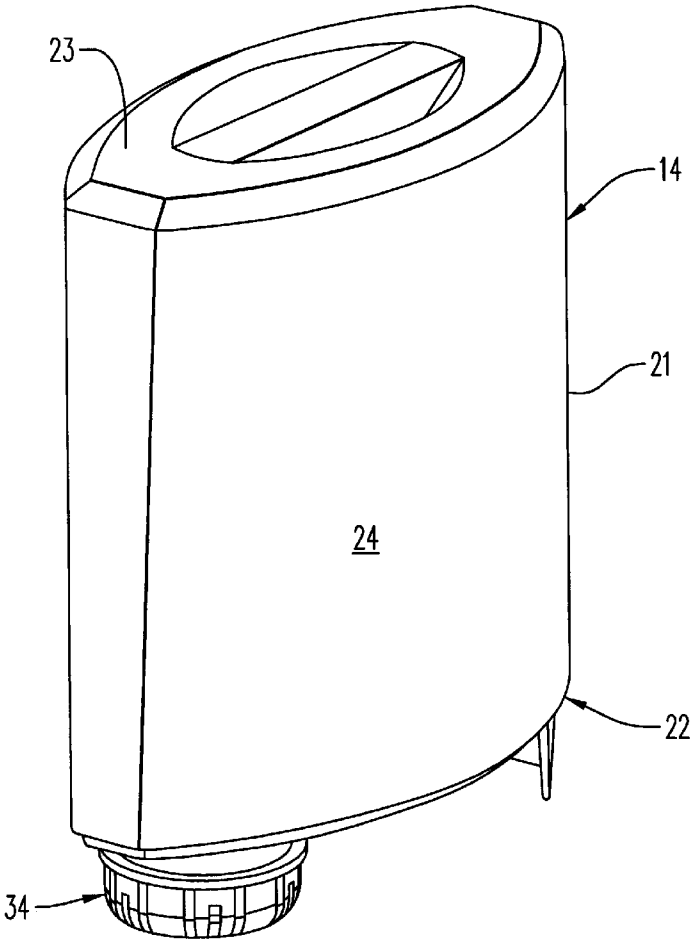
FIG. 2 is a perspective view of a removable liquid storage tank used with the humidifier shown in FIG. 1.
Figure 4:
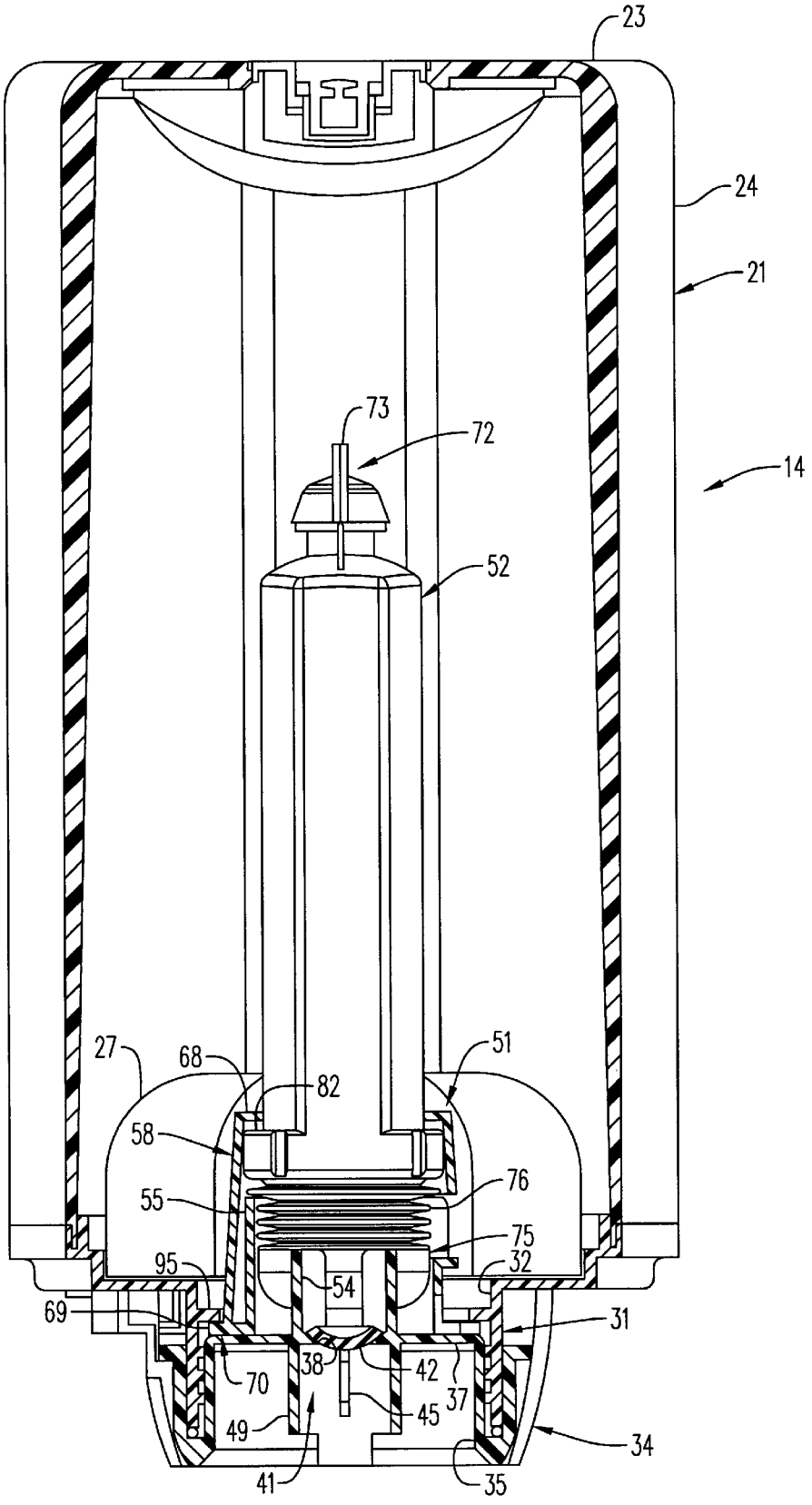
FIGS. 4, 4*a* and 4*b* are partial cross-sectional views of the dispenser assembly of FIG. 3 shown in different position within the storage tank of FIG. 2.
Figure 4A:
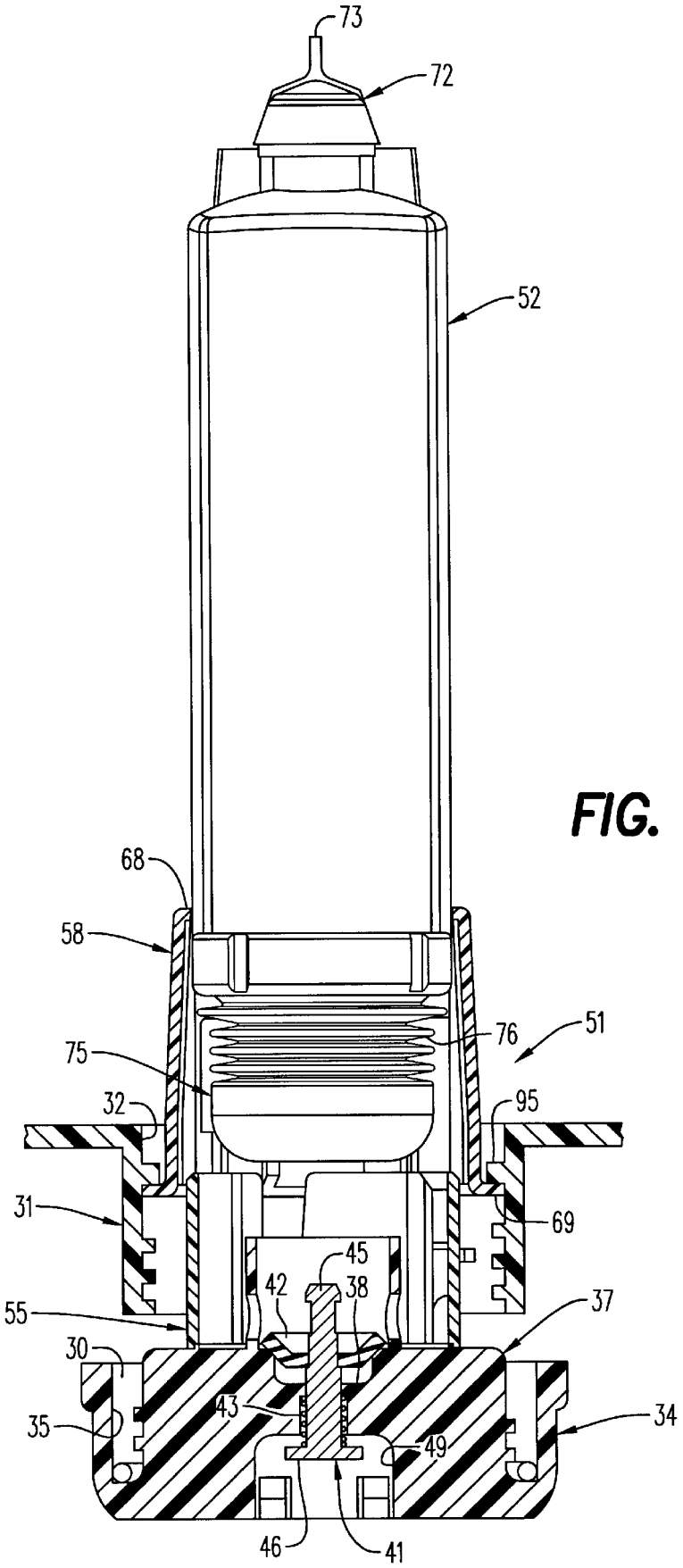
Figure 4B:
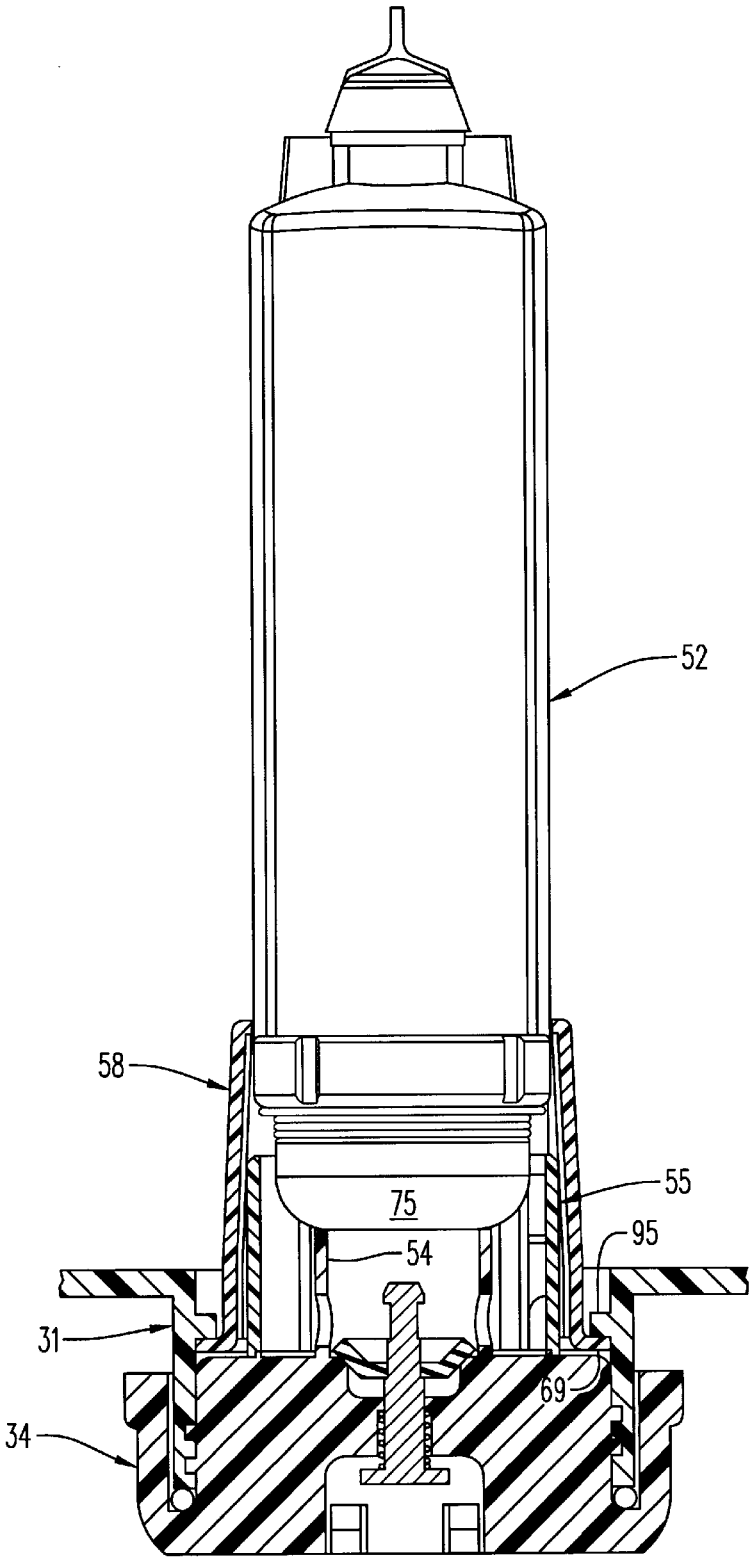

The tank 14 (FIG. 2) includes an inverted cup shaped housing 21 and a lid portion 22 permanently sealed in an open bottom end thereof and forming a bottom wall. A top wall 23 of the tank 14 is joined to the bottom wall 22 by vertical side wall portions 24 of the housing 21. The horizontally positioned lid portion 22 is supported on a top edge 25 (FIG. 1) of the base portion 12. As illustrated in FIGS. 4*a* and 4*b*, a sleeve 31 projects downwardly from the lid portion 22 and defines a fill opening 32 for the storage tank 14. Covering the fill opening 32 is a cap 34 having a reentrance portion 35 forming a cavity 30 which defines external threads that engage internal threads on the downwardly projecting sleeve 31.

Figure 5:
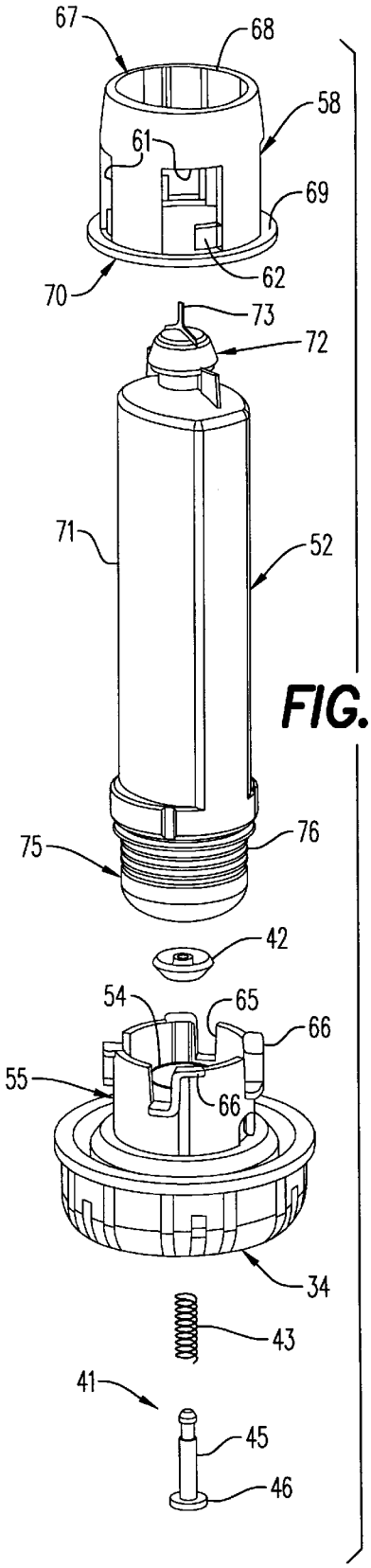
FIG. 5 is an exploded view of the liquid storage tank shown in FIGS. 2–4; end

Extending axially through a central body portion 37 of the cap 34 is a water discharge passage 38. Water flow through the opening 38 is regulated by a valve assembly 41. As shown in FIGS. 4*a*, 4*b* and 5, the valve assembly 41 includes a valve seal 42 retained in a closed position within the opening 38 by a compression spring member 43 retained in compression by a valve stem 45 between the central body portion 37 and an and piece 46. In response to engagement of the end piece 46 with a stop (not shown) in the reservoir 17, the valve seal 42 is forced into an open position to produce a regulated flow of water from the tank through the opening 38 into the reservoir 17. The flow is controlled in a conventional manner by a slotted recess 49 communicating with the valve discharge opening 38 and retaining the end piece 46.

The dispensing system 15 includes an actuator assembly 51 for inducing discharge of a liquid treatment substance from a container 52. As shown in FIGS. 4 and 5, the actuator assembly 51 includes a slotted engagement sleeve member 54 surrounding the discharge opening 38 and extending upwardly from the body portion 37, a coaxial cylindrical support 55 surrounding the sleeve member 54 and also projecting upwardly from the central body portion 37, and a cylindrical coupling collar 58 slidably supported on an outer surface of the cylindrical support 55. A conventional bayonet type connection between the coupling collar 58 and support cylinder 55 is facilitated by circumferentially distributed pairs of openings 61 and tabs 62 in the coupling collar 58 and circumferentially distributed pairs of mating pairs of slots 65 and retainer flanges 66 in the cylindrical support 55. Extending inwardly from one end 67 of the coupling collar 58 is a shoulder portion 68 while an outwardly directed flange portion 69 projects outwardly from an opposite end 70 thereof.

Figure 6:
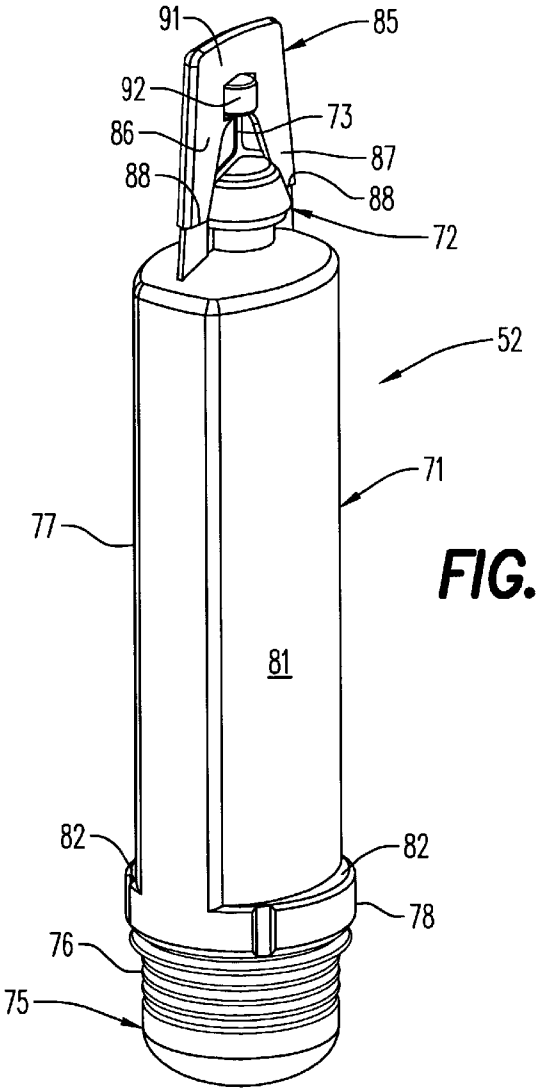
FIG. 6 is a perspective view of a liquid treatment substance container prior to assembly in the storage tank shown in FIGS. 2 and 5.

The container 52 (FIGS. 4–6) is filled with a suitable treatment substance such as a bacteriastat substance and includes a mid-portion 71 straddled by one end portion 72 defining a discharge opening orifice 73 and an opposite end portion 75. Forming the opposite end portion 75 is a resilient bellows wall section 76 which is contractible in response to the application of force and expandable to a normal position in response to removal of the force. The mid-portion 71 of the container 52 consists of a tubular portion 77 having an elliptical cross-section and a circular collar portion 78 joining the tubular portion 77 to the opposite end portion 75. Oppositely facing longitudinal wall portions 81 of the tubular portion 77 are recessed from the periphery of the circular collar portion 78 so as to form transversely projecting retainer flange portions 82. Preferably, the container 52 is a molded unitary member including a detachable tab closure 85 for the discharge opening 73 as shown in FIG. 6. The tab closure 85 has bifurcated legs 86, 87 joined by severable connections 88 to the tubular portion 77 and a mid-portion 91 joined to the one end portion 72 by a severable connection 92 sealing the discharge orifice 73.

Figure 3:
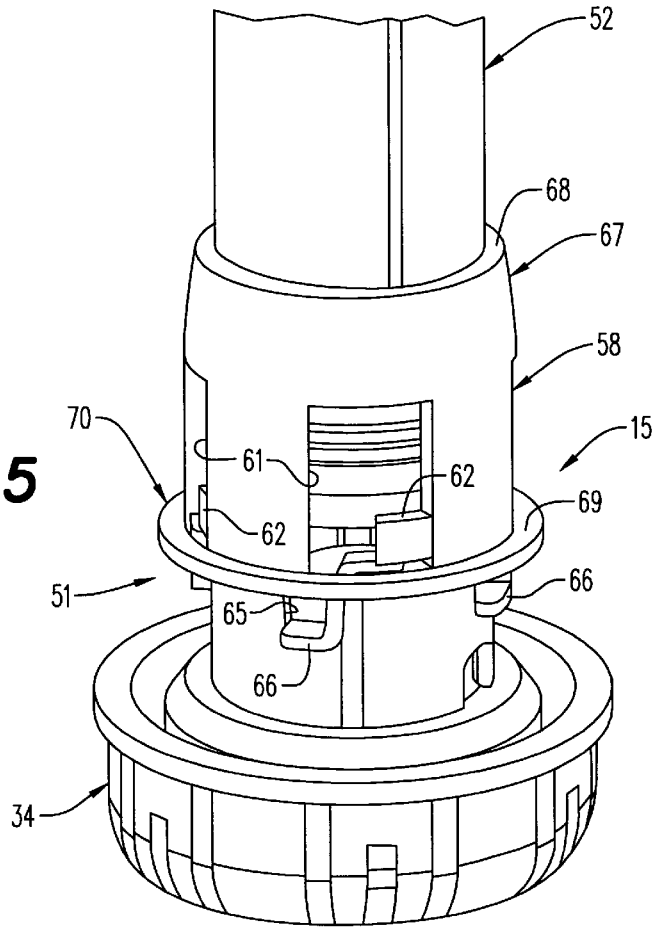
FIG. 3 is an elevational view of a liquid treatment dispenser assembly used with the humidifier depicted in FIG. 1.

Prior to use of the humidifier 11, the combined cap 34 and actuator assembly 51 are unscrewed and removed from the storage tank 14. Next, the cylindrical coupling collar 58 is separated from the support cylinder 55. The one end portion 72 of a container 52 then is inserted through the opposite end 70 of the coupling collar 58 and moved longitudinally therethrough until the retainer flange portions 82 on the mid-portion 72 engage the shoulder portions 68 on the one end 67 of the collar 58. The coupling collar 58 then is slidably engaged with the support cylinder 55 via the bayonet connector tabs 62 and 66 as shown in FIG. 3 and the closure tab 85 (FIG. 6) is detached to open the discharge orifice 73 of the container 52.

After the tank 14 is filled with water from a suitable tap, the container 52 and actuator assembly 51 are inserted through the fill opening 32 as illustrated in FIG. 4*a*. The cap 34 then is screwed tightly into the tank sleeve 31 as shown in FIG. 4*b*. During the insertion process, the flange 69 on the coupling collar 58 engages an inwardly directed flange 95 on the upper end of the sleeve 31 to prevent further relative movement between the coupling collar 58 and restrained mid-portion 71 of the container 52. However, continued tightening of the cap 34 on the sleeve 31 produces relative movement between the sleeve member 54 and the end portion 75 of the container 52 which is fixed to the tank 14. That relative movement causes the engagement sleeve member 54 to exert on the engaged opposite end portion 75 a force producing contraction of the resilient bellows wall section 76 as shown in FIG. 4*b*. Accordingly, the volume of the container 52 is reduced, increasing pressure therein and expelling through the discharge opening 73 of the container 52 into the water content of the tank 14 a given dose portion of treatment substance.

The tank 14 then is inverted and replaced on the base 23 and the humidifier 11 operated in a conventional manner to provide discharge of moisture into the surrounding environment. After its water content has been dissipated, the tank 14 again can be removed from the base 12 and re-filled as described above. During the re-filling process, unscrewing of the cap 34 from the sleeve 31 eliminates the application of force by the engagement sleeve member 54 on the opposite end portion 75 of the container 52 and allowing the resilient bellows wall section 76 to expand creating a vacuum within the container 52. Consequently, air is drawn into the container 52 through the discharge opening 73. When the cap and container 52 are again inserted into the inverted container tank 14, air within the container 52 rises toward the opposite end portion 75 and forcing the remaining treatment substance content of the container toward the one end portion 72. Accordingly, tightening of the cap 34 onto the sleeve 31 of the tank 14 produces through the discharge orifice 73 of the container 72 expulsion of another dose portion of treatment substance as described above. Thus, each filling and capping of the tank 14 produces discharge of a given dose portion of container treatment substance into the water within the tank 14 until the entire content of the container 52 has been exhausted. At that time, an empty container 52 can be replaced by a filled container 52 in the manner described above.

Obviously, many modifications and variations of the present invention are possible in light of the above teachings. It is to be understood, therefore, that the invention can be practiced otherwise than as specifically described.

What is claimed is:

1. A humidifier comprising:

a base defining a reservoir for liquid;

a humidification mechanism for inducing dispersion of moisture withdrawn from said reservoir;

a liquid storage tank having an outlet communicating with said reservoir and adapted to feed liquid thereto, said tank being removably mounted on said base and defining a fill opening for accommodating a filling operation of said tank with liquid;

a container for retaining a volume of a liquid treatment substance and defining a discharge opening communicating with said storage tank; and actuator means operable to induce the discharge of a given dose portion of said treatment substance through said discharge opening into said storage tank; said actuator means comprising a cap removably securable to said tank over said fill opening, and wherein securement of said cap to said tank induces said discharge of a said given dose portion of said treatment substance.

2. A humidifier according to claim 1 wherein said actuator means further comprises a coupling mechanism retaining said container within said tank and adapted to respond to said securement by increasing liquid pressure in said container to thereby induce a said discharge of a given dose portion of said treatment substance.

3. A humidifier according to claim 2 wherein said cap is removably securable to said tank by engageable threads thereon, and wherein relative movement between said tank and said cap during engagement of said threads induces said discharge of said given dose portion.

4. A humidifier according to claim 3 wherein said container comprises one end portion defining said discharge opening and an opposite end portion contractible to reduce the volume of said container and thereby produce said increase in liquid pressure therein.

5. A humidifier according to claim 4 wherein said opposite end portion is formed by a resilient bellows wall section contractible in response to the application of force and expandable in response to removal of said force.

6. A humidifier according to claim 5 wherein said coupling mechanism is adapted during said relative movement between said tank and said cap to restrict relative movement between said tank and said container while allowing contraction of said bellows wall section.

7. A humidifer according to claim 6 wherein said container comprises a retainer portion disposed between said one end portion and said bellows wall section; and said coupling mechanism comprises a cylindrical collar securing said retainer portion to said tank and an engagement member moveable with said cap and engageable with said bellows wall section.

8. A humidifier according to claim 7 wherein said retainer portion comprises transversely projecting flange portions engaged by inwardly directed shoulder portions defined by one end of said cylindrical collar.

9. A humidifier according to claim 8 wherein said engagement member is disposed for movement within said collar.

10. A humidifier according to claim 9 wherein said cylindrical collar has an opposite end defining an outwardly directed flange with an upper surface engaged by a contact surface of said tank so as to prevent relative movement between said cylindrical collar and said tank during said relative movement between said cap and said tank.

11. A humidifier according to claim 10 wherein said container has a mid-portion including a tubular portion with an elliptical cross-section and a substantially circular collar portion joining said tubular portion to said bellows wall section.

12. A humidifier according to claim 11 wherein wall portions of said tubular portion are recessed from said circular collar portion so as to form said transversely projecting flange portions engaged by said shoulder portions of said cylindrical collar.

13. A humidifier according to claim 12 wherein said discharge opening is an orifice having a diameter between 0.2 and 0.3 millimeters.

14. A container filled with a liquid treatment substance for humidifiers of the type having a liquid supply reservoir communicating with a liquid storage tank with a cap covered fill opening; said container comprising:

one end portion defining a discharge opening;

an opposite end portion defining a bellows wall section contractible to reduce the volume of said container; and a mid-portion defining a liquid storage chamber of substantial volume and disposed between said bellows wall section and said one end portion, and a flange retainer portion transversely projecting from said mid-portion adjacent to said bellows wall section; and wherein said flange retainer portion is adapted to engage the humidifier and restrain movement of said mid-portion when said bellows wall section is engaged and contracted by the cap.

15. A container according to claim 14 wherein said discharge opening is an orifice having a diameter between 0.2 and 0.3 millimeters.

16. A container according to claim 15 wherein said container is a molded unit including a tab closing said orifice and detachable to open said orifice.

17. A container according to claim 14 wherein said mid-portion comprises a tubular portion with an elliptical cross-section and a substantially circular collar portion joining said tubular portion and said bellows wall section, and wherein wall portions of said tubular portion are recessed from said circular collar portion so as to form said transversely projecting flange retainer portion.

* * * * *